US005546117A

United States Patent [19]

Ohno et al.

[11] Patent Number: 5,546,117

[45] Date of Patent: Aug. 13, 1996

[54] PORTABLE STORAGE MEDIUM AND APPARATUS FOR PROCESSING THE SAME

[75] Inventors: Tadayoshi Ohno; Takashi Yamaguchi; Shinichi Itoh, all of Kawasaki, Japan

[73] Assignee: Kabushiki Kaisha Toshiba, Kawasaki, Japan

[21] Appl. No.: 207,659

[22] Filed: Mar. 9, 1994

[30] Foreign Application Priority Data

Mar. 11, 1993 [JP] Japan ..... 5-050668

[51] Int. Cl.[6] ..... B41J 2/435

[52] U.S. Cl. ..... 347/224; 347/171; 347/221

[58] Field of Search ..... 347/224, 221, 347/171; 400/120.01

[56] References Cited

FOREIGN PATENT DOCUMENTS

| | | | |
|---|---|---|---|
| 57-14096 | 1/1982 | Japan . | |
| 58-56859 | 4/1983 | Japan | 347/1 |
| 2-204087 | 8/1990 | Japan . | |
| 2-209290 | 8/1990 | Japan . | |
| 3-71383 | 3/1991 | Japan . | |
| 3-160067 | 7/1991 | Japan | 347/171 |
| 3-177994 | 8/1991 | Japan . | |
| 3-234670 | 10/1991 | Japan . | |
| 4-112086 | 4/1992 | Japan . | |

*Primary Examiner*—Huan H. Tran

*Attorney, Agent, or Firm*—Cushman Darby & Cushman, L.L.P.

[57] ABSTRACT

A magnetic recording layer is formed on one surface of a card-shaped base plate. A printing layer, for printing visible information such as "matters to be attended", is formed on the magnetic recording layer. A laser recording layer is formed on the other surface of the base plate. A visible image, which can be color-developed by radiation of a laser beam, can be recorded on the laser recording layer. The surface of the recording layer is coated with a transparent protection film, and a predetermined pattern is printed on the protection film. The laser recording layer includes a photothermic conversion material and a thermosensitive recording material. The photothermic conversion material has a major absorption wavelength corresponding to a major wavelength of the laser beam. A visible image can be recorded on the card by means of a laser beam without damaging a predetermined pattern on the protection film. Falsification of the visible image by means of a thermal pen can easily been discovered by checking a defect on the predetermined pattern. Therefore, falsification can be prevented.

3 Claims, 3 Drawing Sheets

5546117

PORTABLE STORAGE MEDIUM AND APPARATUS FOR PROCESSING THE SAME

BACKGROUND OF THE INVENTION

1. Field of the Invention

The present invention relates to a portable storage medium requiring security, such as an ID card, a pass, a prepaid card or a telephone card, and to a portable storage medium processing apparatus for performing issuance processing of the portable storage medium or collation processing at the time of operations using the portable storage medium.

2. Description of the Related Art

Recently, magnetic cards have been used in various fields as portable storage media such as telephone cards, prepaid cards and ID cards. With prevalence of such cards, however, there have been occurred problems: fraudulent processing by a third party of magnetically recorded information, e.g. fake or falsification, and illegal use of the cards.

In order to deal with the above problems, a visible image recording area may be provided on the surface of a magnetic card, and fixed visible information may be recorded on this recording area. Accordingly, security is enhanced by checking both magnetic information and visible information.

In general, however, a numerical value is employed as a visible image to be recorded as fixed information. Thus, a part of the image of the numeral value may be changed. For example, "6" may be illegally changed to "8". As has been stated above, stored magnetic information can be falsified with relative case. Thus, the security of the magnetic card becomes dependent upon the case with which the image information is falsified.

On the other hand, other methods for enhancing security have been proposed based on naked eye detection: a method using a holographic image in which an image of the user's face is directly printed on the surface of the magnetic card, or a sheet bearing the photographic image of the user's face is attached on the surface of the magnetic card (e.g. Jap. Pat. Appln. KOKAI Publication No. 3-71383), a method using precise printing techniques.

The methods using holography or precise printing, however, are expensive, and once the printed image is falsified successfully, fraudulent cards may be mass-produced. In addition, in the method of attaching a thin sheet bearing the image of the user's face on the magnetic card, the sheet may be peeled off and reattached on another card illegally. Moreover, there is another method for preventing falsification of the photograph of the face, in which a mark is put on the recorded image of the face (e.g. Jap. Pat. Appln. KOKAI Publication No. 3-234670).

A generally used method of recording a visible image on a magnetic card is a thermosensitive recording method using a thermal head or a thermal transfer recording method. A recording portion on which the image is recorded by the thermosensitive recording method is formed of a thermosensitive recording material which develops color due to heat. In the thermal transfer recording method, a recording portion is formed of an ink receiving layer. In these recording portions, in general, a protection film is not provided on a recording layer.

Consequently, the fixed information recorded on the recording portion, which represents the value of the card, may be falsified by means of a pen, etc. In order to prevent falsification, it is known to form a protection film on the recording portion after the fixed information is recorded.

Even if the protection film is provided, however, the image on the recording portion can be falsified externally by means of a thermal pen, etc. in the case of the thermosensitive recording method. On the other hand, in the case of the thermal transfer recording method, a detection of falsification is easier since false information is added by ink on the protection film. However, protection film forming means, in addition to the recording means, must be provided in the card issue apparatus, resulting in complexity of the apparatus and an increase in apparatus size, processing time and costs.

There have also been proposed a non-contact recording method of recording a visible image. According to this method, a recording sheet is formed by providing, on a base sheet, a recording layer consisting of a photothermic conversion material, which absorbs a laser beam of a oscillation wavelength and converts it to heat, and a thermosensitive recording material. A laser beam modulated according to image information is radiated on the recording sheet, thereby effecting non-contact recording (e.g. Jap. Pat. Appln. KOKAI Publications Nos. 57-14096 and 2-204087).

In this recording method, however, the image forming material is the same as the thermosensitive recording material. Therefore, the degree of difficulty of falsification is about the same as in the thermosensitive recording method.

As has been described above, the prior-art techniques fail to provide a sufficient check system with respect to falsification of recording portions of portable storage media, and falsification of visible images on the recording portions.

SUMMARY OF THE INVENTION

The object of the present invention is to provide a portable storage medium which simplifies the detecting and preventing of false visible image representing the value of the portable storage medium such as a card. In addition, another object of this invention is to provide a portable storage medium processing apparatus capable of recording a visible image on a recording portion without damaging a printed pattern on a protection film, at the time of issuing the portable storage medium. Still another object of the invention is to provide a portable storage medium processing apparatus which can enhance the security at the time of using the portable storage medium.

According to a first aspect of the invention, there is provided a portable storage medium comprising: a storage portion for storing predetermined information; a recording layer for being recorded visible images corresponding to the information stored in the storage portion by being heated at a certain temperature; and a pre-printed pattern layer formed on a surface of the recording layer which will receive damages by heating at temperatures above the temperature in contact with a heating source. The recording layer includes a photothermic conversion material having a major absorption wavelength corresponding to the major wavelength of the laser beam, and a color-developing material which develops color due to heat generated by the photothermic conversion material.

According to a second aspect of the invention, there is provided a portable storage medium comprising: a storage portion for storing predetermined information; a recording layer for recording a visible image corresponding to the information stored in the storage portion by converting laser beam to heat, the laser beam being irradiated at the layer, having a major wavelength and representing the information stored in the storage portion; a transparent protection film formed on the recording layer which receives damages by heating above the temperature in contact with a heating source; and a transparent pre-printed pattern layer formed on the protection film, having such characteristics that the transparent pre-printed pattern is optically separable from the visible image to be recorded on the recording layer.

According to a third aspect of the invention, there is provided an apparatus for determining genuineness of a visible image of a visible image recording portion, the apparatus comprising: a portable recording medium having a base, a first recording layer provided on one surface of the base, information being recorded on the first recording layer, a second recording layer provided on the other surface of the base, a visible image being recorded on the second recording layer by a laser beam, and a protection film formed on the second recording layer, a transparent pre-printed pattern being printed on the protection film; a storage portion for storing the pre-printed pattern as image information in advance; an image input portion for reading an image of the pre-printed pattern of the protection film, and providing the read image; a collation portion for collating the read image from the image input portion with the pre-printed pattern stored in the storage portion, thereby providing a collation result; and a genuineness determining portion for determining the genuineness of the portable storage medium on the basis of the collation result from the pattern collation portion.

Additional objects and advantages of the invention will be set forth in the description which follows, and in part will be obvious from the description, or may be learned by practice of the invention. The objects and advantages of the invention may be realized and obtained by section of the instrumentalities and combinations particularly pointed out in the appended claims.

DETAILED DESCRIPTION OF THE PREFERRED EMBODIMENTS

Embodiments of the present invention will now be described with reference to the accompanying drawings.

Figure 1:
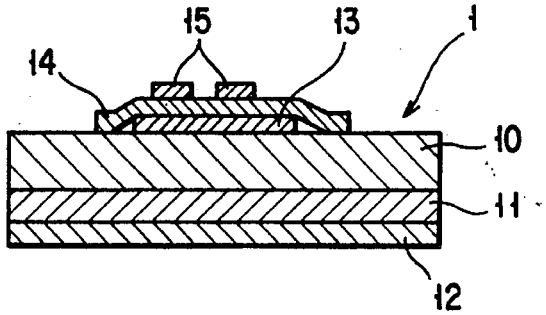
FIG. 1 is a vertical cross-sectional view showing the structure of a card for using facilities as a portable storage medium according to an embodiment of the present invention.

FIG. 1 shows in detail the structure of a card 1 for using facilities. That card embodies the portable storage medium according to the present invention. Reference numeral 10 denotes a card-shaped base 10 formed of a plastic material of, e.g. white vinyl chloride or polyethylene terephthalate. A magnetic recording layer 11 on which information is magnetically recorded is formed on one surface (lower surface) of the base 10. A printing layer 12, on which visible information such as matters to be attended to is printed, is formed on the surface of the magnetic recording layer 11. A recording layer 13, on which a colored visible image obtained by use of a laser beam can be recorded, is formed on the other surface (upper surface) of the base 10. The surface of the recording layer 13 is coated with a transparent protection film 14. A predetermined pattern (pattern layer) 15 is printed on the protection film 14.

The recording layer 13 is made of a material consisting of a photothermic conversion material, a thermosensitive recording material, a white pigment and a binder, and the layer 13 has a light or white ground color. It is desirable that the main absorption wavelength of the photothermic conversion material be the main wavelength of a laser beam output from an optical recording apparatus (described later). In this embodiment, in accordance with the main light-emission wavelength of 830 nm of a semiconductor layer oscillator 4, near-infrared radiation absorption material is used as the photothermic conversion material. Near-infrared radiation absorption materials include a cyanine coloring matter and a thiol-nickel complex. Bis (1, 6-dichloro-3, 4-dithiophenolate) platinum-tetrabutylammonium is desirable since it whitens the ground color of the near-infrared radiation absorption material which is colorless or light-colored.

As the thermosensitive recording material, a thermosensitive color-developing material consisting of a combination of conventional electron-donative leuco dye and electron-acceptive organic color-developing material. Electron-donative leuco dyes include crystal violet lactone and 3-diethylamino-6-methyl-7-anilinofluorene. Electron-acceptive organic color-developing materials include bis-phenols A and 4-hydroxybenzoic ester.

After the recording layer 13 is formed on part of the upper surface of the base 10, lower surface on which the magnetic recording layer 11 and printing layer 12 have been formed, the recording layer 13 is coated with the protection film 14. Recording layer material suitable for laser-beam recording and formation of the recording layer are taught in, e.g. Jap. Pat. Appln. KOKAI Publications Nos. 57-14096 and 2-209290.

A material having no absorption with respect to the wavelength of a laser beam emitted from an optical recording apparatus 3 is suitable as material of the protection film 14. Besides, the protection film 14 is needed to have such transparency that a visible image formed on the recording layer 13 can easily be recognized. If such transparency is kept, the protection film 14 may be colored. Also, it is optically separable from the information recorded on the recording layer 13. A thermoplastic resin is used as a material of a protection film on which a pattern is printed. Such a resin is, for example, vinyl resin, polyethylene, polystyrene, etc. A melting point of a vinyl resin or vinyl chloride resin is about 200° C., a melting point of polyethylene is 100° to 150° C., and a melting point of polystyrene is 200° to 240° C. The thermoplastic resin is thermally deformed by heat generated by an exothermic resistor of a thermal head (about 200° to 400° C., though varying depending on the condition of recording). A thin layer is formed of the thermoplastic resin as protection layer 14. A pattern may be directly formed of the thermoplastic resin on the recording layer.

When the protection film 14 is formed, the recording layer 13 is not color-developed. For example, as disclosed in Jap. Pat. Appln KOKAI Publication No. 4-112086, an adhesive may be put on a peripheral portion of the protection film 14, which does not face the recording layer 13, and this peripheral portion may be adhered to the base 10.

Figure 2A:
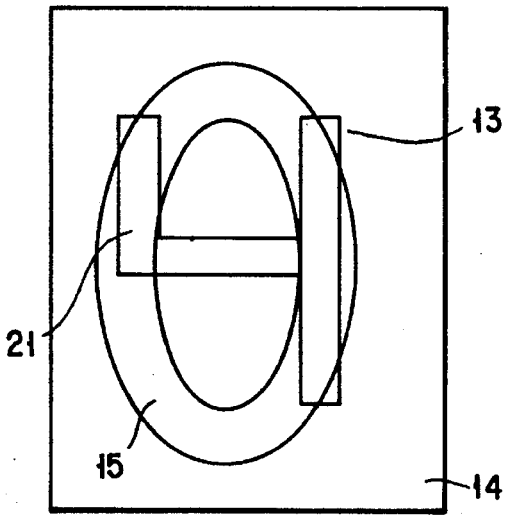
FIG. 2A and FIG. 2B are plan views of cards, FIG. 2A showing a recording portion of the card shown in FIG. 1, and FIG. 2B showing a recording portion of the falsified card.

The card 1 of this embodiment is characterized in that the recording layer 13, protection film 14 and printing pattern 15 are laminated on the same side surface of the base 10. Pattern formation on the protection film 14 will now be described with reference to FIG. 2A and FIG. 2B. FIG. 2A is a plane view of the card 1, showing only a recording portion including the recording layer 13 and a printed pattern formed on the recording layer 13. In the card 1 according to this embodiment, a printed pattern 15 of character "0" is printed on the protection film 15 by light red ink. The layer of the ink should desirably be as thin as possible while the printed character is legible. Reference numeral 21 denotes character information "4" recorded by laser radiation. The laser-recorded information "4" can be viewed by the naked eye through the printed pattern 15 on the protection film 14.

Figure 3:
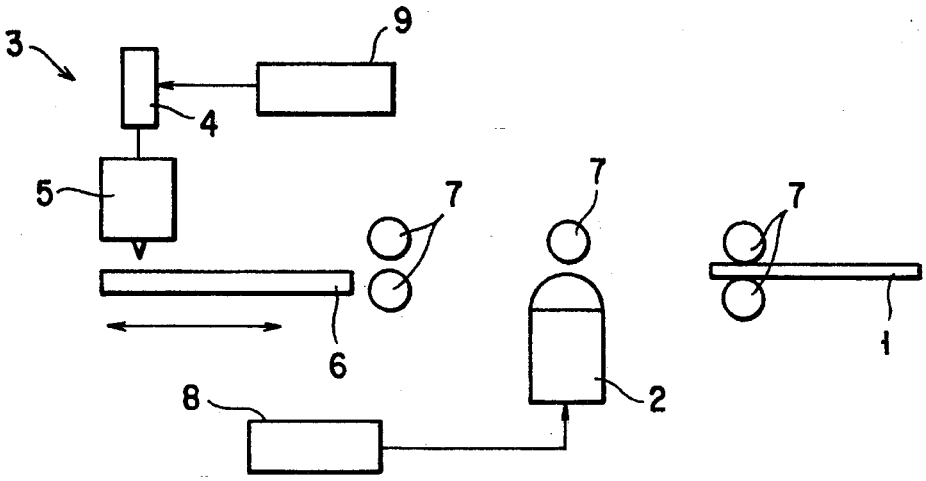
FIG. 3 shows schematically the structure of a main portion of a card processing apparatus for processing the card according to the embodiment of the invention.

FIG. 3 shows schematically the main portion of a card processing apparatus for issuing the card 1 according to the present embodiment. The card 1 is a card for use in facilities with a term of validity, and it is a portable storage medium having the magnetic recording layer 11 and visible image recording layer 13 on which a visible image is thermally recorded by light radiation. A magnetic head 2 is a magnetic recording/reading section for recording on the magnetic recording layer of card 1 such magnetic recording information as a term of validity, the owner's name and the name of facilities, or collating the written magnetic information.

The optical recording apparatus 3 comprises a semiconductor laser 4 for emitting a laser beam, e.g. with light-emission wavelength of 830 nm and an output power of 50 mW, and a laser scan optical system 5 for scanning the emitted laser beam. The semiconductor laser 4 oscillates according to visible image information signal input from a laser drive electric circuit 9 and emits the laser beam. The laser scan optical system 5 comprises, for example, a collimator lens (not shown), a scanning optical system (not shown) and a converging lens group (not shown). The laser scan optical system 5 scans a laser beam modulated according to the visible image information linearly in a direction perpendicular to the direction of conveyance of the card 1.

The optical recording apparatus 3 may be of a conventional type, not requiring special features. In an example of the optical recording apparatus 3, a specific converging lens is used to stably record picture elements, even in the case where the surface of the recording layer has some unevenness (e.g. see Jap. Pat. Appln. KOKAI Publication No. 2-204087).

The card 1 is fixed on a movable table 6 and moved in the directions of a double-headed arrow (horizontal direction in FIG. 3). Information recording by the laser beam emitted from the optical recording apparatus 3 is effected in a non-contact manner, and generally the focal depth is not great. In this apparatus, in order that the laser beam may be exactly focused in the visible image recording layer 13 of the card 1, the card 1 is horizontally fixed on the movable table 6 and moved. Convey rollers 7 are driven by a motor (not shown) to move the card 1 in the directions of the double-headed arrow.

Referring to FIGS. 1 to 3, the card issuance operation of the above-described card processing apparatus will now be described. A new non-issued card 1 on which pre-printed pattern 15 is printed is inserted from an insertion port (not shown). The card 1 is conveyed by the convey rollers 7 to a location above the magnetic head 2. The magnetic head 2 writes on the magnetic recording layer 11 of the card 1 information representing the name of the card owner and the term of validity as magnetic information, which has been input from a host apparatus (not shown) under the control of a magnetic head controller 8.

After the magnetic information has been written on the card 1, the card 1 is further conveyed and fixed on the movable table 6 with the recording layer 13 situated upwards. The movable table 6 moves at a speed corresponding to the scanning speed of the laser optical system 5. Specifically, the movable plate 6 moves to the left (in FIG. 3) at a speed corresponding to a dot pitch of a visible image to be recorded on the recording layer 13 in a single scan cycle.

When the recording layer 13 of the card 1 has reached a predetermined position, the optical recording apparatus 3 starts to record the visible image. Specifically, laser recording information to be recorded on the recording layer 13, e.g. information on the term of validity, is input to the laser drive electric circuit 9, and the semiconductor laser 4 is driven according to the input information and emits light.

The laser beam from the semiconductor laser 4 is made to scan at a scan speed of about 50 mm/s in a direction perpendicular to the direction of movement of the card 1, thereby effecting recording for one line. The laser beam is made incident on the recording layer 13 via the protection film 14. The incident laser beam is absorbed in the near-infrared radiation absorption material of the recording layer 13 and converted to heat. Thus, the near-infrared radiation absorption material generates heat in accordance with the intensity of the incident beam. By the generated heat, the thermosensitive recording material melts and mixes to develop color. The temperature at which the color develops is 60° C. or above. Once the one-line scan is completed, the movable table 6 moves by a distance corresponding to the one-dot pitch, and the scan for the second line begins. In this way, the laser recording information is recorded on the recording layer 13.

Since the laser recording information "4" shown in FIG. 2A is recorded by the heat generated by the near-infrared absorption material of the recording layer 13, the printed pattern 15 on the protection film 14 is not damaged. Damage is avoided primarily because the laser beam energy is hardly absorbed in the protection film 14, the beam is not focused at the protection film 14, and the temperature scarcely increases.

After the recording of the visible image is completed by the optical recording apparatus 3, the movable table 6 moves to the right in FIG. 3 and the card 1 is conveyed back to the location above the magnetic head 2. The magnetic head 2 reads the information on the term of validity, etc. which were already written on the magnetic recording layer 11, and the read information is fed to a term-of-validity collation unit (described below). Then, the information on the term of validity is collated and, if "coincidence" of information is confirmed, the card 1 is ejected from the insertion port (not shown).

Figure 2B:
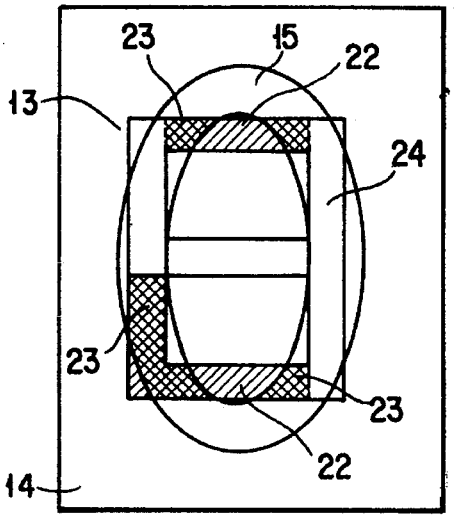

Referring to FIGS. 2A and 2B, the advantageous effect for preventing the falsification of the recording portion of the issued card 1 will now be explained. Suppose that the term-of-validity information "4" recorded by the laser beam on the recording layer 13 of card 1 has been illegally changed to "8".

As regards the character "4" shown in FIG. 2A, which was recorded by the optical recording apparatus 3, a hatched portion 22 and a cross-hatched portion 23 of the recording layer 13 are heated through the protection film 14 by means of a thermal pen, etc., as shown in FIG. 2B. As a result, the heated portions of the recording layer 13 are developed color, and the character "4" is falsified to character "8" or false information 24.

At this time, the pattern 15 corresponding to the cross-hatched portion 23 has also been heated. In general, the color-development temperature of the thermosensitive material of the recording layer 13 is about 60° C. to 100° C. Thus, in order to make the thermosensitive material of the recording layer 13 develop color through the protection film 14, it is necessary to heat the protection film 14 at temperatures of about 150° C. or above. Due to this heating, the protection film 14 is softened or melted, and the crosshatched portion 23 of the pattern 15 is destroyed. That is, the portion 23 is rubbed off or corrugated by thermal contraction. Consequently, after falsification, the cross-hatched portion 23 of the character "0" of the pattern 15 is lost or deformed, and the falsification is easily confirmed by the naked eye.

A card processing apparatus for determining genuineness of the card issued as described above will now be described with reference to FIG. 4.

Figure 4:
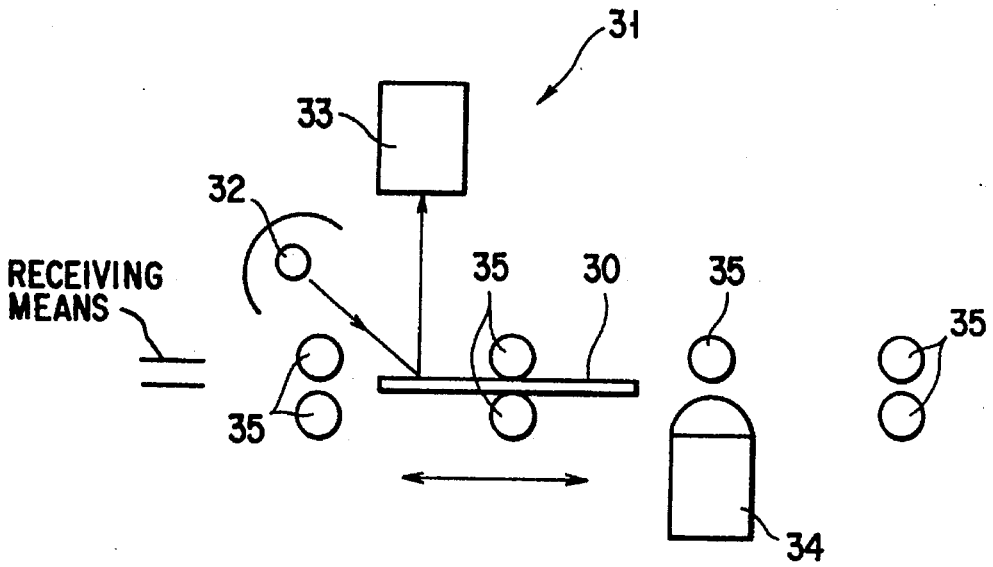
FIG. 4 shows schematically the structure of a main portion of a card processing apparatus which determines the genuineness of the card according to the embodiment.

FIG. 4 shows schematically the main portion of the card processing apparatus. Reference numeral 30 denotes a card according to the present embodiment for use in facilities with a term of validity. A pattern read unit 31 constitutes a part of a pattern genuineness determining apparatus (not shown), and it includes, for example, an ultraviolet lamp 32 and a fluorescent sensor 33. The pattern read unit 31 optically reads a printed pattern on the card 30. A magnetic head 34 records or reads magnetic information. Convey rollers 35 are driven by a motor to move the card 30 horizontally (in FIG. 4).

Since the card 30 has the same structure as the card 1 shown in FIG. 2 except for the pre-pattern, a detailed description thereof is omitted. As shown in FIG. 5, a bar code 41 is printed as a pre-pattern on the protection film 14 of the card 30 by colorless or light-colored fluorescent ink. A general fluorescent ink may be used. The pre-pattern 41 printed by fluorescent ink is colorless or light-colored.

Figure 5A:
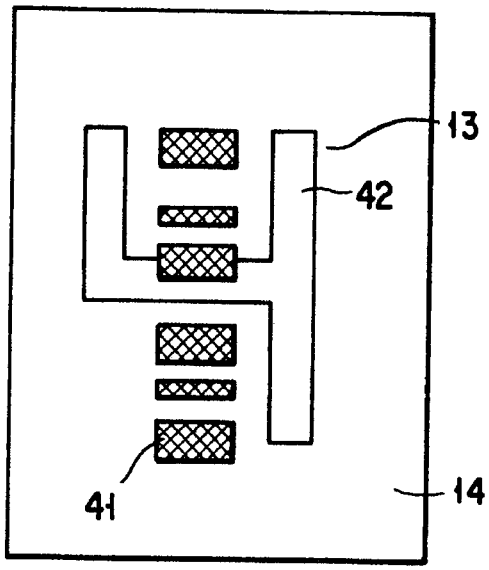
FIG. 5A and FIG. 5B are plan views of cards, FIG. 5A showing a recording portion of the card used for the card processing apparatus shown in FIG. 4, and FIG. 5B showing a recording portion of the falsified card.

By the above-described card processing apparatus shown in FIG. 2, similar information on the term of validity, etc. is magnetically recorded on the magnetic recording layer 11 of the card 30. In addition, as is shown in FIG. 5A, like the above-described recording layer 13 of the card 1, term-of-validity information 42 is recorded by the laser beam. In FIG. 5A, the information 42 is character "4". Since the pre-pattern 41 on the protection film 14 is colorless or light-colored, only the term-of-validity information appears to be displayed at first glance.

Figure 6:
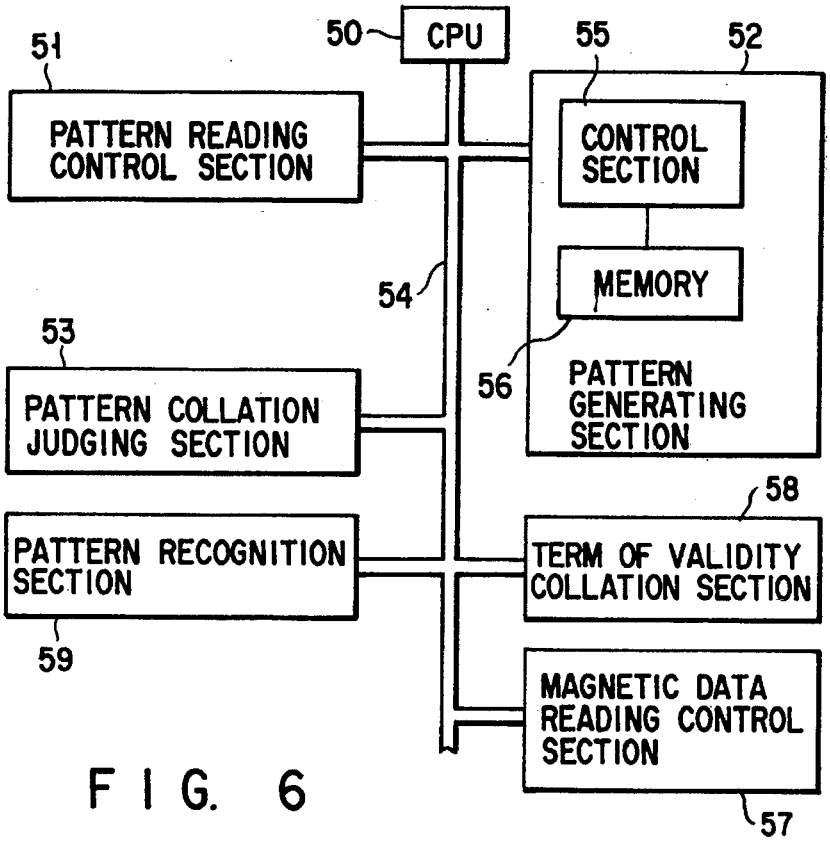
FIG. 6 is a block diagram showing the structure of that portion of the card processing apparatus shown in FIG. 4, which relates mainly to collation processing.

FIG. 6 shows the electric structure of that part of the card processing apparatus shown in FIG. 4, which relates to the collation processing. A CPU (Central Processing Unit) 50 totally controls the operations of the entire apparatus. A pattern reading control section 51 controls the pattern read unit 31. A register pattern generating section 52 generates a reference pattern registered in advance in the apparatus. A pattern collation/judging section 53 collates the read pattern with the reference pattern generated by the register pattern generating unit 52, thereby judging the genuineness of the read pattern. A magnetic data reading control section 57 controls the operation for reading magnetic information on the card. A term-of-validity collation section 58 collates the magnetic information read by the control unit 57 and the present date. These sections are connected via a bus 54. The register pattern generating section 52 comprises a control section 55 for controlling the operation of pattern generating section 52 and a memory 56 for storing the registered reference pattern. A pattern recognition section 59 recognizes a pattern read by the pattern reading control section 51, and compares the recognition result with a pre-registered character code.

Figure 7:
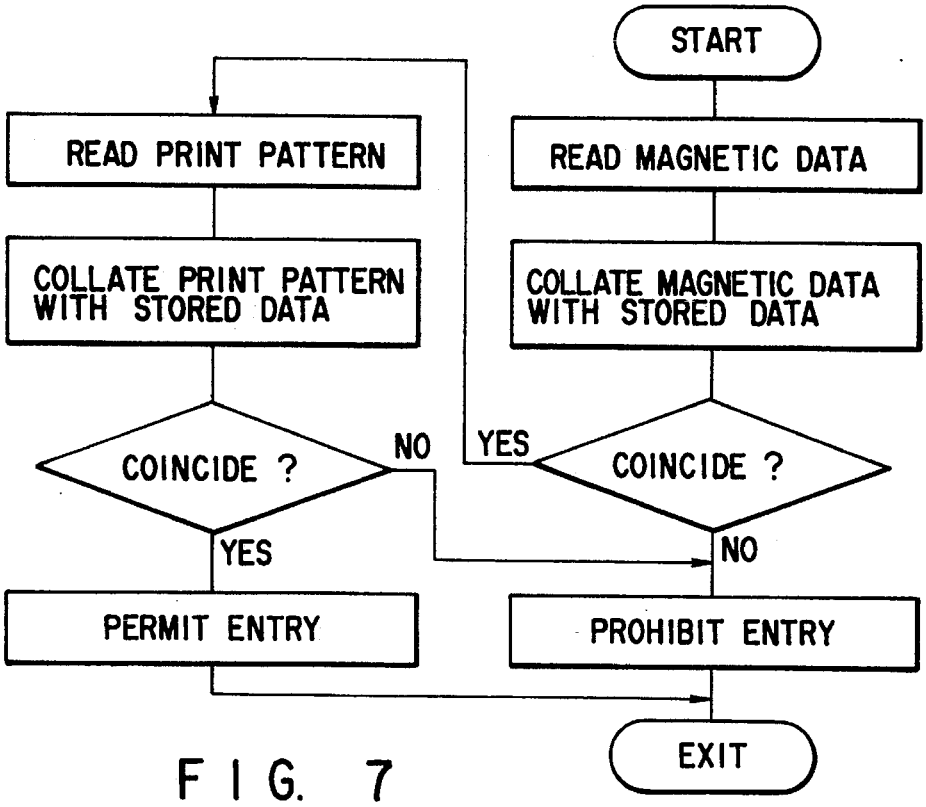
FIG. 7 is a flow chart for illustrating the processing operation of the card processing apparatus shown in FIG. 4.

Referring to a flow chart of FIG. 7, the operations of the structure illustrated in FIGS. 4 and 6 will now be described. The card 30 on which, for example, the term-of-validity information is recorded is inserted in the card processing apparatus shown in FIG. 4 from the insertion port (not shown). The card 30 is conveyed by the convey rollers 35 to a location above the magnetic head 34. The magnetic data reading control section 57 reads the information on the term of validity, etc. from the magnetic recording layer 11 of the card 30 by means of the magnetic head 34, and sends the read information to the term-of-validity collation section 58. The collation section 58 collates the read magnetic information with information on the present date. If both do not coincide, the card 30 is returned to the insertion port, and the entry of the owner into the facility is prohibited.

If both coincide, the card 30 is conveyed to the left in FIG. 4. While the recording layer 13 of the card 30 is being moved, it is irradiated with the ultraviolet lamp 32 of the pattern read unit 31. Thereby, the fluorescent agent in the fluorescent ink is excited by the ultraviolet and fluorescent light is emitted. The fluorescent light is emitted from only the portion corresponding to the pre-pattern 41 on the protection film 14. When the entire pre-pattern on the protection film 14 has been scanned by the fluorescent sensor 33 with movement of the card 30, the sensed pattern information is sent to the pattern collation/judging section 53.

The CPU 50 sends a command to the control section 55 of the register pattern generating section 52, thereby making the section 55 to generate a register pattern. According to this command, the control section 55 reads out pre-registered pattern data from the memory 56 and sends it to the pattern collation/judging section 53. The collation/Judging section 53 collates the pattern data read from the register pattern generating section 52 with the pattern data sent from the pattern read unit 31 via the pattern reading control section 51.

If the collation result is non-coincidence ("No"), the CPU 50 generates a warning sound or causes the display unit of the card processing apparatus to indicate to that effect. In this manner the CPU 50 warns the operator of the card processing apparatus and prohibits the entry. If the collation result is coincidence ("Yes"), the card 30 is conveyed to the right in FIG. 4, and information on the recording layer 11 is updated by the magnetic head 34. Then, the card 30 is returned through the insertion port (not shown), and the entry of the operator is permitted.

The wavelength of the emitted light (fluorescence) of the pattern (bar code) 41 printed on the protection film 14 is about 300 nm to 400 nm and it can easily be separated from the visible light wavelength of the visible image. Therefore, a high S/N is obtained, and the pre-pattern can be exactly sensed.

Next, with reference to FIG. 5A and FIG. 5B, the variation of the pre-pattern 41 due to falsification of the recording portion of the card 30 having the above structure will now be described. Suppose that laser recording information "4" recorded on the recording layer 13 of the card 30 has been illegally changed to "8".

Figure 5B:
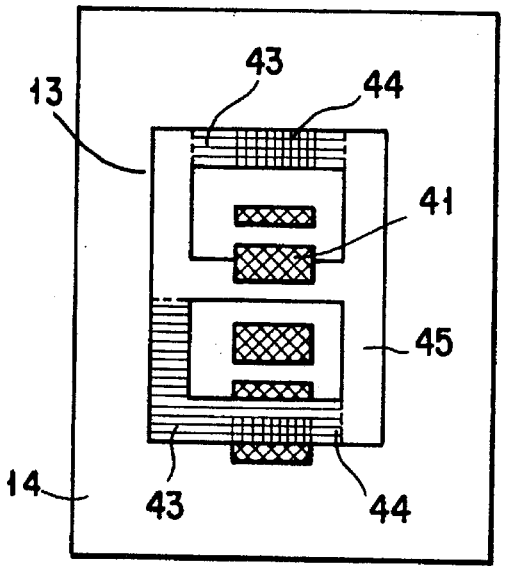

As regards the character "4" shown in FIG. 5A, a hatched portion 43 and a lattice-hatched portion 44 have been heated through the protection film 14 by means of a thermal pen, etc., as shown in FIG. 5B. As a result, the heated portions of the recording layer 13 have 10 developed color, and the character "4" has been falsified to character "8" or false information 45.

The pre-pattern 41 corresponding to the lattice-hatched portion 44 has also been heated. As described above, in general, the color-development temperature of the thermosensitive material of the recording layer 13 is about 60° C. to 100° C. Thus, in order to make the thermosensitive material of the recording layer 13 develop color through the protection film 14, it is necessary to heat the protection film 14 at temperatures of about 150° C. or above. Owing to this heating, the pre-pattern 41 of the lattice-hatched portion 44 is destroyed. After falsification, the lattice-hatched portion 44 is lost from the bar code of the pre-pattern 41.

In the above example in which the card 1 having the visible image pre-pattern has been falsified, the falsified portion can easily be confirmed by the naked eye by virtue of the missing of the pre-pattern. In the example in which the card 30 having the fluorescent pre-pattern has been falsified, the falsified portion cannot be confirmed by the naked eye. However, the fluorescent pre-pattern itself is defective. Thus, even in the case where the magnetic information, as well as the laser-recorded information, has been falsified, the falsification can easily be judged by the pre-pattern collation/judgment using the fluorescent sensor 33.

An improved security system can be achieved by the card for use in facilities having the above-described structure and the card processing apparatus. In the above embodiment, the pattern on the protection film is formed by means of printing. However, an uneven pattern, for example, may be formed on the protection film by means of an embossing process.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. An apparatus for recording predetermined information on a portable recording medium having a visible image recording portion, said apparatus comprising:

a portable recording medium having a first recording layer on which invisible information is recorded, a second recording layer on which visible information is recorded via heat generated by converting light to heat, and a transparent pre-printed pattern layer formed on said second recording layer;

first recording means for recording said invisible information on said first recording layer of said portable recording medium; and second recording means for recording said visible information on said second recording layer of said portable recording medium as a visible image by light.

2. An apparatus for determining genuineness of a visible image of a visible image recording portion, said apparatus comprising:

a portable recording medium having a base, a first recording layer provided on one surface of said base, information being recorded on said first recording layer, a second recording layer provided on the other surface of said base, a visible image being recorded on said second recording layer by a laser beam, and a protection film formed on said second recording layer, a transparent pre-printed pattern being printed on said protection film;

storage means for storing said pre-printed pattern as image information in advance;

image input means for reading an image from said pre-printed pattern on said protection film, and for generating said image;

collation means for collating said image generated by said image input means with said pre-printed pattern stored in said storage means, and for generating a collation result based on said collation; and genuineness determining means for determining the genuineness of said portable recording medium based on said collation result generated by said collation means.

3. An apparatus for determining genuineness of a visible image of a portable recording medium having a base, a first recording layer provided on one surface of said base, information being recorded on said first recording layer, a second recording layer provided on the other surface of said base, a visible image being recorded on said second recording layer by a laser beam, and a protection film formed on said second recording layer, a transparent pre-printed pattern being printed on said protection film, said apparatus comprising:

storage means for storing a pre-printed pattern as image information in advance;

image input means for reading an image from said pre-printed pattern on a protection film, and for generating said image;

collation means for collating said image generated by said image input means with said pre-printed pattern stored in said storage means, and for generating a collation result based on said collection; and genuineness determining means for determining the genuineness of a portable recording medium based on said collation result generated by said collation means.

* * * * *